US005591113A

United States Patent [19]

Darnell et al.

[11] Patent Number: 5,591,113

[45] Date of Patent: Jan. 7, 1997

[54] CENTRIFUGALLY ASSISTED CENTRIFUGE BOWL MOUNT

[75] Inventors: Lawrence Darnell, Cypress, Tex.; James Salter, Morietta, Ga.

[73] Assignee: COBE Laboratories, Inc., Colo.

[21] Appl. No.: 332,820

[22] Filed: Oct. 31, 1994

[51] Int. Cl.[6] ..... B04B 15/00

[52] U.S. Cl. ..... 494/12; 494/84; 279/3; 279/106; 279/131

[58] Field of Search ..... 494/41, 43, 84, 494/85, 12; 279/3, 35, 89, 93, 106, 129, 131; 269/21

[56] References Cited

U.S. PATENT DOCUMENTS

| | | | |
|---|---|---|---|
| 1,864,191 | 6/1932 | Eidam | 279/131 |
| 2,207,621 | 7/1940 | Hite | 279/131 X |
| 2,345,786 | 4/1944 | Berg | 279/131 X |
| 2,443,895 | 6/1948 | Day et al. | 279/106 X |
| 2,839,307 | 6/1958 | Garrison et al. | 279/131 |
| 3,317,127 | 5/1967 | Cole . | |
| 3,581,981 | 6/1971 | Latham, Jr. | 494/84 X |
| 3,706,412 | 12/1972 | Latham, Jr. | 494/84 X |
| 3,785,549 | 1/1974 | Latham, Jr. | 494/85 X |
| 4,183,545 | 1/1980 | Daly | 279/3 |
| 4,684,361 | 8/1987 | Feldman et al. . | |
| 4,692,136 | 9/1987 | Feldman et al. . | |
| 4,718,888 | 1/1988 | Darnell . | |
| 4,795,419 | 1/1989 | Yawn et al. . | |
| 4,838,849 | 6/1989 | Calari | 494/85 |
| 5,062,826 | 11/1991 | Mantovani et al. | 494/85 |

FOREIGN PATENT DOCUMENTS

| | | | |
|---|---|---|---|
| 225647 | 8/1995 | Germany | 279/131 |
| 60-79724 | 5/1985 | Japan | 279/131 |
| 5-261608 | 10/1993 | Japan | 279/129 |
| 665951 | 6/1979 | U.S.S.R. | 279/131 |
| 688295 | 9/1979 | U.S.S.R. | 279/131 |

*Primary Examiner*—Charles E. Cooley

*Attorney, Agent, or Firm*—Finnegan, Henderson, Farabow, Garrett, & Dunner, L.L.P.

[57] ABSTRACT

A centrifuge is provided with a mounting arrangement that secures a centrifuge bowl to a turntable in response to centrifugal force generated when the turntable is rotated. The centrifuge includes first and second retainers, one of which is connected to the turntable, while the other is connected to the centrifuge bowl. The second retainer engages the first retainer when the first and second retainers are in an interlocking position to secure the centrifuge bowl to the turntable. A movable arm is provided on the turntable and coupled to the second retainer, the movable arm has a ballast that forces the movable arm and second retainer in a first direction in response to centrifugal force generated by rotating the turntable so that the second retainer is forced into the interlocking position with the first retainer. In one embodiment, a vacuum applied to an opening in the turntable assists in mounting a centrifuge bowl to the turntable.

10 Claims, 3 Drawing Sheets

CENTRIFUGALLY ASSISTED CENTRIFUGE BOWL MOUNT

FIELD OF THE INVENTION

The present invention relates to a centrifuge. More particularly, the present invention relates to a mounting arrangement that secures a centrifuge bowl to a centrifuge turntable.

DESCRIPTION OF RELATED ART

Centrifuge devices are used to separate components from a liquid such as blood. In use, the liquid is initially placed in a centrifuge container and the container is attached to a mount of the centrifuge device. The mount and container are then rotated at a very rapid speed. A centrifugal force is generated within the liquid during this rotation and the centrifugal force acts to separate components from the liquid. Examples of these devices are shown in U.S. Pat. Nos. 4,684,361; 4,692,136; 4,795,419; and 4,718,888.

Centrifuge devices are subjected to extreme forces when the mount and centrifuge container are rotated rapidly. These extreme forces apply stresses to the attachment between the mount and container. When the container and mount are rotated for a period of time, failure of the attachment between the mount and container is possible. If this attachment fails, the centrifuge container can separate from the mount and break. This attachment failure can also disconnect tubing previously connected to the centrifuge container. A potentially hazardous substance, such as blood, could be released if the centrifuge container is broken or the tubing is separated after failure of the attachment.

As shown in the patents referenced above, attempts have been made to improve the attachment structure between the container and mount of a centrifuge device. These attachments, however, are deficient, because desired attachment and removal of the container to and from the mount is difficult. Further, close fitting movable mounting parts can lock together after accidental blood spillage.

SUMMARY OF THE INVENTION

Accordingly, the present invention is directed to a centrifuge that substantially obviates one or more of the limitations of the related art.

To achieve these and other advantages and in accordance with the purpose of the invention, as embodied and broadly described herein, the invention comprises a centrifuge having a centrifuge bowl with a chamber to contain material. At least one passage is provided on the centrifuge bowl to allow for ingress and egress of the material to and from the centrifuge bowl. The centrifuge has a turntable with a surface for receiving the centrifuge bowl. A motor is coupled with the turntable for rotating the turntable. Means are provided on the turntable for securing the centrifuge bowl to the turntable in response to rotation of the turntable.

Preferably, the invention comprises a centrifuge mounting arrangement. The centrifuge mounting arrangement includes a rotatable turntable having a surface for receiving an object. Means are provided on the rotatable turntable for mounting the object to the rotatable turntable; and means are provided on the rotatable turntable for securing the object to the rotatable turntable with a securing force that increases in response to rotation of the turntable.

In another preferred embodiment of the present invention, the centrifuge includes a centrifuge bowl having a chamber for receiving material and at least one passage provided on the centrifuge bowl to allow for ingress and egress of the material to and from the centrifuge bowl. The centrifuge has a turntable with a surface for receiving the centrifuge bowl and a motor, which is coupled with the turntable for rotating the turntable. The centrifuge also includes first and second retainers, one of which is disposed along the turntable, while the other is provided on the centrifuge bowl. The first and second retainers are adapted to interlock, thereby securing the centrifuge bowl to the turntable.

In addition, the turntable may include a movable arm to facilitate engagement between the first and second retainers. The movable arm, which is coupled to the second retainer, has a ballast that forces the movable arm and second retainer in a first direction in response to centrifugal force generated by the rotation of the turntable so that the second retainer is forced into the interlocking position with the first retainer.

It is to be understood that both the foregoing general description and the following detailed description are exemplary, and are intended to provide further explanation of the invention as claimed. The accompanying drawings are included to provide a further understanding of the invention and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
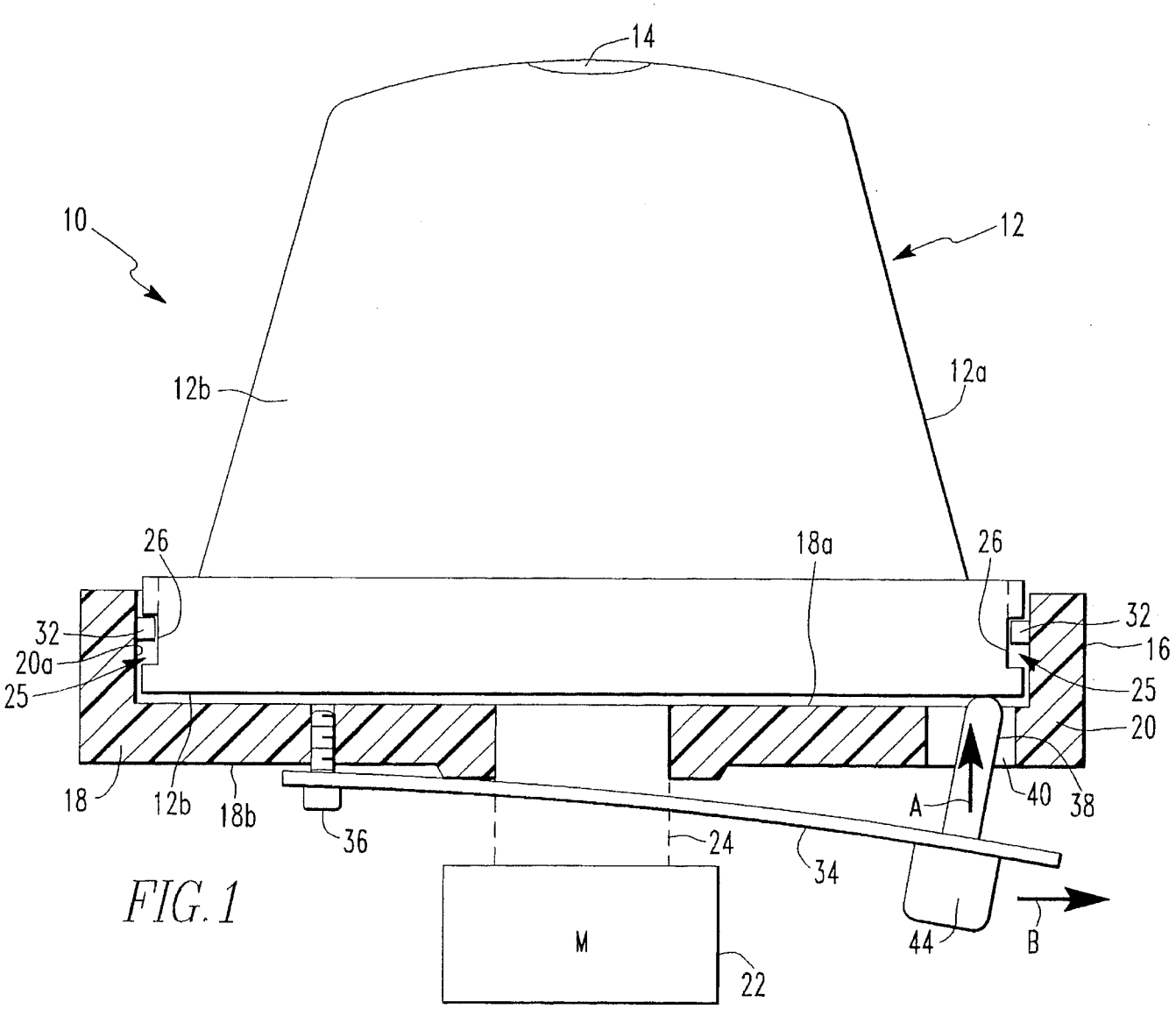
FIG. 1 is a cross sectional view of a preferred embodiment of the centrifuge of the invention.

Reference will now be made in detail to the present preferred embodiments of the invention, examples of which are illustrated in the accompanying drawings. Wherever possible, the same reference numbers will be used in the drawings and the description to refer to the same or like parts.

In accordance with the invention, the present invention includes a centrifuge comprising a centrifuge bowl having a chamber for receiving material to be centrifuged. As embodied herein and illustrated in FIG. 1, the present invention preferably includes a centrifuge 10 having a centrifuge bowl 12 with walls 12*a* defining a centrifuge chamber 12*b* that is adapted to receive material, such as blood or another liquid. The centrifuge bowl 12 is constructed to separate components of the material within the centrifuge bowl 12 when the centrifuge bowl 12 is rotated about a vertical axis. Accordingly, the centrifuge bowl 12 includes passage 14 to enable the material to pass into the centrifuge chamber 12*b*. The passage 14 also allows for component removal after the material has been centrifuged in the centrifuge bowl 12. A swing arm (not shown in the drawings) may be used to stabilize the centrifuge bowl 12 during a centrifuging process by holding a top portion of the centrifuge bowl 12.

In accordance with the present invention, a turntable is provided with a surface for receiving the centrifuge bowl. As embodied herein and shown in FIG. 1, the turntable 16 includes a bottom plate 18 and a side wall 20. The side wall 20 substantially surrounds the bottom plate 18 and extends above a top surface 18*a* of the bottom plate 18. The top surface 18*a* of the bottom plate 18 and an interior surface 20*a* of the side wall 20 form a generally cylindrical area for receiving a portion of the centrifuge bowl 12.

In accordance with the present invention, a motor is provided to rotate the turntable. As shown in FIG. 1, a motor 22 is coupled to the turntable 16 through a coupler 24 to rotate the turntable 16. The coupler 24 may include a shaft that is directly connected to the motor 22, see FIG. 1. Alternatively, the coupler 24 may connect the turntable 16 to the motor 22 through the use of gears or other conventional transmissions.

Figure 2:
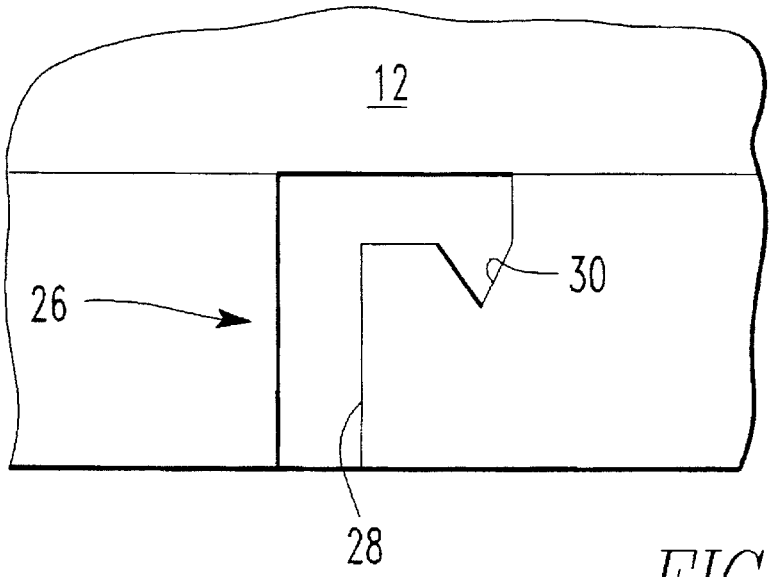
FIG. 2 is an enlarged side view of a bayonet retainer slot on the outer wall of the centrifuge bowl shown in FIG. 1.
Figure 3:
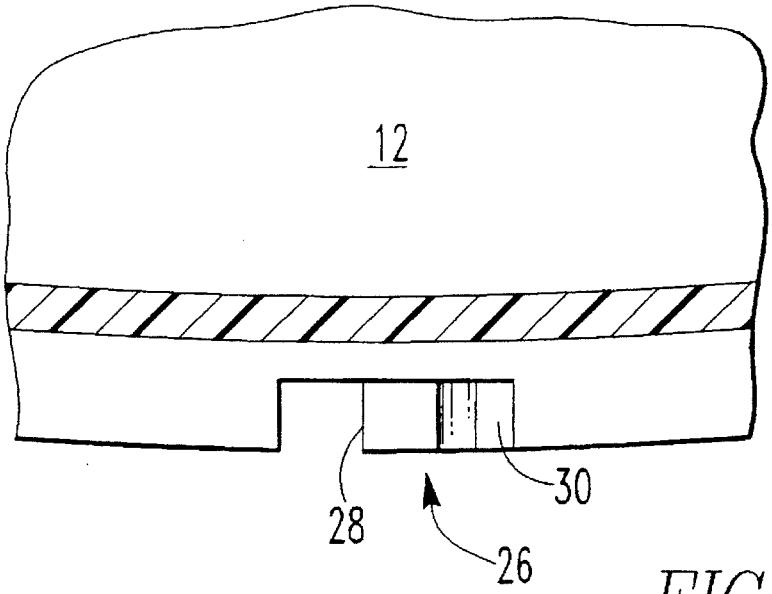
FIG. 3 is a top view of the bayonet retainer slot shown in FIG. 2.

In accordance with the present invention, the centrifuge also may include retaining means for mounting the centrifuge bowl on the turntable. As embodied herein and shown in the FIG. 1, the retaining means comprises at least one retainer 25, such as a slot 26, positioned on the outer wall 12*a* of the centrifuge bowl 12 adjacent the bottom of the centrifuge bowl 12. As shown in more detail in FIGS. 2 and 3, each slot 26 may have a bayonet shape with an inlet section 28 that is open at the bottom of the centrifuge bowl 12. The top of the inlet section 28 is connected with a groove 30. While two slots are depicted in FIG. 1, any number of slots can be positioned on the outer wall 12*a* of the centrifuge bowl 12. Further, pins could be substituted for the slots on the outer wall 12*a*.

As embodied herein and shown in FIG. 1, the retaining means also comprises at least one retainer pin 32 positioned on the interior surface 20*a* of the side wall 20 of the turntable 16. The number of retainer pins 32 depends on the number of slots 26, in as much as the retainer pins 32 are positioned at a location corresponding to the location of the slots 26 on the centrifuge bowl 12. It will be readily appreciated that slots could be substituted for the retainer pins 32 on the interior surface 18*a* of the side wall 20, if corresponding retainer pins are provided on the outer wall 12*a*.

Accordingly, the centrifuge bowl 12 is adapted to be positioned on the turntable 16 within the area bounded by the interior surface 20*a* of the side wall 20 and the top surface 18*a* of the bottom plate 18, so that the slots 26 on the centrifuge bowl 12 are aligned with the retainer pins 32 on the turntable 16, thereby enabling the retainer pins 32 to engage the respective inlet section 28. As the centrifuge bowl 12 is moved downwards toward the bottom plate 18, the centrifuge bowl 12 is rotated about the vertical axis and then moved upwards to place each retainer pin 32 within a respective groove 30. When the retainer pin 32 is within the groove 30, first and second retainers 25, 32 are interlocked, enabling the centrifuge bowl 12 to be secured to the turntable 16.

In accordance with the present invention, the turntable includes a movable arm that is coupled with the retaining means. As embodied herein and shown in FIG. 1, the turntable includes a resilient arm 34 connected by a fastener 36 along one end to the bottom surface 18*b* of the bottom plate 18. The resilient arm 34 may be constructed of a leaf spring material. The fastener 36 can consist of a screw, rivet or the like. Preferably, three resilient arms are disposed at locations 120° relative to one another along the bottom surface 18*b* of the bottom plate 18.

As embodied herein, the free end of resilient arm 34 includes a projection 38 that is adapted to extend through an aperture 40 in the bottom plate 18. When a centrifuge bowl 12 is placed on the turntable 16, the resilient arm 34 bends and biases the projection 38 in a first direction, as generally shown by an arrow identified by reference character A, such that the projection 38 contacts the bottom surface 12*b* of the centrifuge bowl 12. The bent or flexed portion of the resilient arm 34 is located away from the aperture 40 and the projection 38 is not closely fit in the aperture 40, therefore blood accidentally spilled in the aperture 40 will not interfere with normal operation. The biasing of the resilient arm 34 forces the centrifuge bowl 12 upwards in the direction A. As such, the groove 30 of the slot 26 is urged toward the retainer pin 32, thus securing the centrifuge bowl 12 to the turntable 16.

As embodied herein and shown in FIG. 1, the resilient arm 34 includes a weight, such as a ballast 44, for providing a mass concentration on the resilient arm 34. The ballast 44 preferably is affixed to the bottom of the resilient arm 34 adjacent to the free end of the arm. When the turntable 16 is rotated, the ballast 44 is subjected to a centrifugal force away from the axis of rotation in a second direction, as generally shown by an arrow identified by reference character B. The centrifugal force of the ballast 46 acts to straighten the bend in the resilient arm 34 and force the projection 38 vertically upwards in the first direction A and into engagement with the bottom surface 12*b* of the centrifuge bowl 12. The centrifuge bowl 12 is forced upwards in the direction A and the groove 30 of the slot 26 is forced into the retainer pin 32. The groove 30 and retainer pin 32 are held in an interlocking position which secures the centrifuge bowl 12 to the turntable 16 during rotation.

As the turntable 16 is rotated at increased speeds, the centrifugal force of the ballast 44 increases. When the centrifugal force of the ballast 44 is increased the upwards vertical force provided by the arm 34 in the direction A is increased. Accordingly, the centrifuge bowl 12 is secured to the turntable 16 with an increased force when the turntable is rotated at increased speeds.

In operation, the centrifuge bowl 12 of FIG. 1 is initially mounted to the turntable 16. The inlet sections 28 of the slots 26 on the centrifuge bowl 12 are aligned with the retainer pins 32 of the turntable 16. The centrifuge bowl 12 is moved toward the bottom plate 18 of the turntable 16 and rotated to align the retainer pins 32 with the grooves 30. When the centrifuge bowl 12 is moved toward the bottom plate 18, the projection 38 of the resilient arm 34 contacts the bottom surface 12*b* of the centrifuge bowl 12 and the resilient arm 34 bends to bias the projection 38 toward the centrifuge bowl 12 in the direction A. The biasing of the projection 38 against the centrifuge bowl 12 forces the centrifuge bowl 12 vertically upwards in the direction A to place the retainer pin 32 within the groove 30 to lock the bowl 12 on the turntable 16.

Once the material to be centrifuged is placed in the chamber 12*a* of the centrifuge bowl 12, the motor 22 is energized to move coupler 24 and impart rotational motion to the turntable 16 and centrifuge bowl 12. When the turntable 16 rotates, the ballast 44 is subjected to a centrifugal force in the direction B. The centrifugal force acts to straighten the resilient arm 34 and forces the projection 38 vertically upwards in the direction A against the bottom surface 12*b* of the centrifuge bowl 12. When the centrifuge bowl 12 is forced vertically upwards in the direction A by the projection 38, the groove 30 on the centrifuge bowl 12 is forced against the retainer pin 32 to secure the centrifuge bowl 12 to the turntable 16. As the speed of the turntable 16 is increased, the centrifugal force and force of the projection 38 in the direction A increase, thus securing the centrifuge bowl 12 to the turntable 16 with an increased securing force.

When rotation of the turntable 16 and centrifuge bowl 12 is complete, the ballast 44 is not subjected to the centrifugal force. As such, the centrifuge bowl 12 can be removed from the turntable 16 with relative ease, because the centrifuge bowl 12 is not secured to the turntable 16 with the force that was generated during rotation of the turntable 16.

Figure 4:
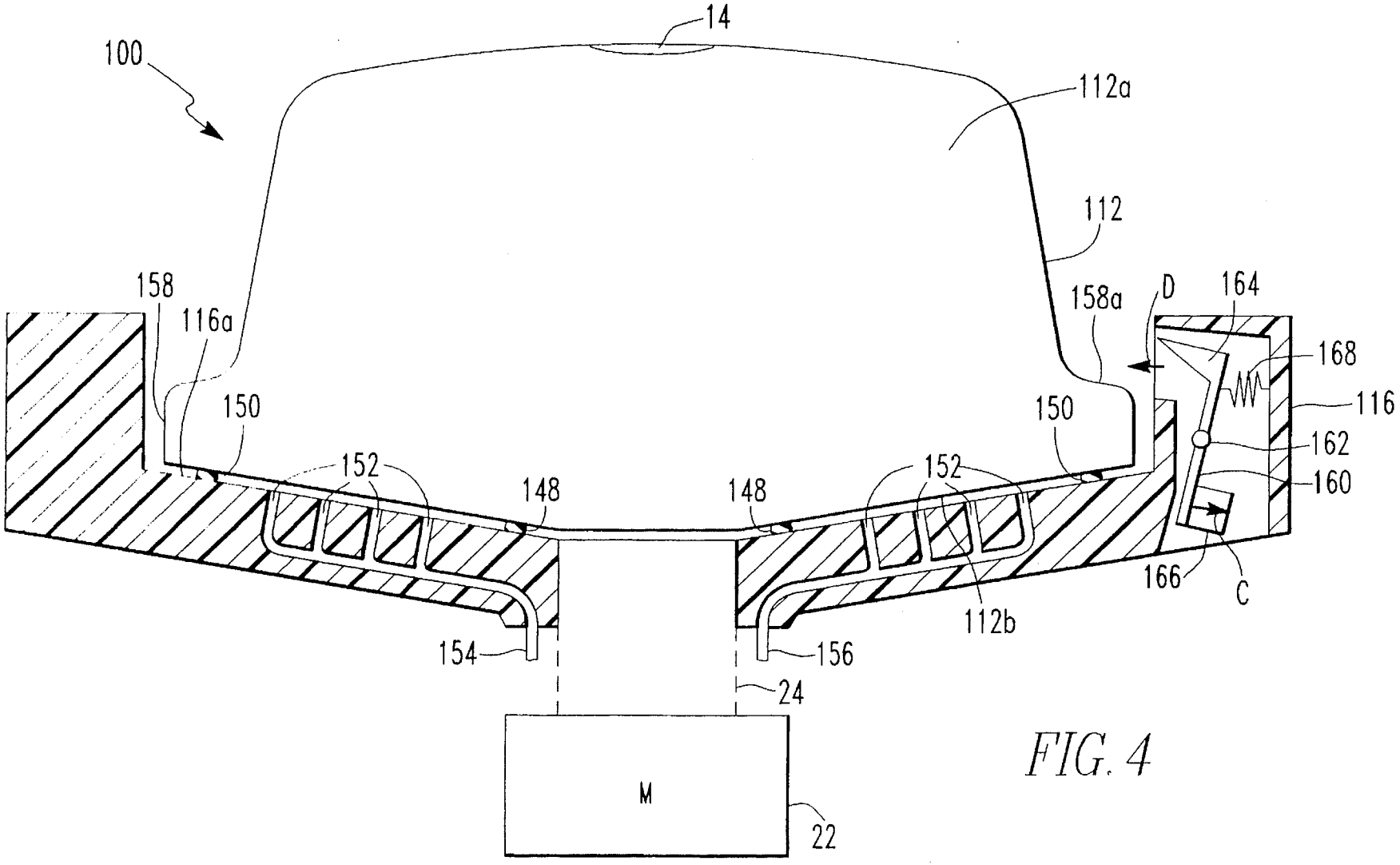
FIG. 4 is a cross sectional view of another embodiment of the centrifuge of the invention.

In an alternative embodiment of the present invention, as embodied herein and shown in FIG. 4, a centrifuge 100 has a bottom surface of a centrifuge bowl 112 placed on a top surface 116*a* of a turntable 116. The turntable 116 has two annular seals 148 and 150 on the top surface 116*a* to contact the bottom surface 112*a* of the centrifuge bowl 112. The top surface 116*a* has openings 152 arranged thereon. Although eight openings are depicted in the view of FIG. 4, any number of openings are possible. The openings 152 communicate with conduits 152, 154 through a series of passages arranged within the turntable 116. The conduits 152, 154 are connected to a vacuum source (not shown) to apply a vacuum force to openings 152. The vacuum force is applied to the bottom surface 112*b* of the centrifuge bowl 12 between the annular seals 148, 150 to mount the centrifuge bowl 112 to the turntable 116.

In accordance with the present invention, the centrifuge bowl includes a retainer. As embodied herein the centrifuge bowl 112 has a retainer that is formed by an upper surface 158*a* of a lip 158 which extends around the periphery of the centrifuge bowl 112.

In accordance with the present invention the turntable includes a movable arm coupled to a retainer. As embodied herein and shown in FIG. 4., turntable 116 has a latching arm 160 pivotally connected at a pivot connection 162. Although FIG. 4 only depicts a single latching arm 160, a plurality of latching arms could be provided around the periphery of the turntable 116. Latching arm 160 has a latching retainer 164 provided adjacent to one end and a ballast 166 provided adjacent an opposite end. The latching retainer 164 is configured to engage the upper surface 158*a* of lip 158 when the latching arm 160 is rotated about pivot connection 162. The latching arm 160 is connected to a spring 168 in order to bias the latching retainer 164 away from the lip 158 with a biasing force.

In operating the embodiment shown in FIG. 4, a centrifuge bowl 112 is initially mounted to the turntable by placing it on the top surface 116*a* of the turntable 116. The spring 168 biases the latching retainer 164 away from the centrifuge bowl 112, so that the latching retainer 164 does not interfere with the centrifuge bowl 112 during mounting. A vacuum force is applied to openings 152 through the conduits 154, 156 to hold the centrifuge bowl 112 to the turntable 116. Material is placed in the chamber 112*a* of the centrifuge bowl 112 through passage 14.

The motor 22 is energized to rotate the turntable 116 and centrifuge bowl 112 through coupler 24. As the turntable 116 is rotated, the ballast 166 is subjected to a centrifugal force that increases with increased rotational speed of the turntable 116. The centrifugal force on the ballast 166 is in a direction as generally shown by an arrow identified by reference character C. The latching arm 160 rotates about the pivot connection 162 when the centrifugal force at the ballast 166 is at a sufficient magnitude to overcome the bias of spring 168. The latching arm 160 moves the latching retainer 164 in a direction as generally shown by the arrow identified by the reference character D. The latching retainer interlocks with the upper surface 158*a* of lip 158 on the centrifuge bowl 112 and secures the centrifuge bowl 112 to the turntable 116.

If the turntable 116 and centrifuge bowl 112 are rotated at an increased speed, the centrifuge bowl 112 is secured to the turntable 116 with an increased force. The latching retainer 164 remains interlocked with the upper surface 158*a* of lip 158 until the speed of rotation for the turntable 116 is decreased to a predetermined magnitude that allows the biasing force of the spring 168 to return the latching arm 160 to the initial position shown in FIG. 4. The ballast 166 and spring 168 may be selected so that the latching arm 160 returns to this initial position when the rotational speed of the turntable 116 is decreased to a magnitude that avoids damage to the centrifuge bowl 112 if the vacuum mount has failed. When the rotation of the turntable 116 and centrifuge bowl 112 is complete, the spring 168 biases the latching arm 160 into the initial position, so that the latching retainer 164 does not interfere with the removal of the centrifuge bowl 112 from the turntable 116.

It will be apparent to those skilled in the art that various modifications and variations can be made to the structure and methodology of the present invention without departing from the scope or spirit of the invention. In view of the foregoing, it is intended that the present invention cover modifications and variations of this invention provided they come within the scope of the following claims and their equivalents.

What is claimed is:

1. A centrifuge comprising:

a centrifuge bowl having a chamber to contain material and at least one passage provided on the centrifuge bowl to allow for ingress and egress of the material to and from the centrifuge bowl;

a turntable having a surface for receiving the centrifuge bowl;

a motor coupled with the turntable for rotating the turntable; and means provided on the turntable for securing the centrifuge bowl to the turntable in response to rotation of the turntable, the securing means comprising a resilient arm having a first end and second end, the resilient arm being mounted to the turntable adjacent the first end and being connected to a ballast adjacent the second end.

2. The centrifuge of claim 1, wherein the securing means is responsive to centrifugal force generated by rotation of the turntable such that the centrifuge bowl is secured to the turntable with an increased force when the turntable is rotated at an increased speed.

3. The centrifuge of claim 1, wherein the securing means further comprises:

an aperture in the turntable; and a projection provided at the second end of the resilient arm and extending through the aperture, the resilient arm biasing the projection such that the projection contacts the centrifuge bowl.

4. The centrifuge of claim 1, further comprising:

a first retainer having at least one of a slot or pin provided on the centrifuge bowl;

a second retainer having the other of said at least one of a slot or pin provided on the turntable, the second retainer adapted to couple with the first retainer in an interlocking position;

wherein the securing means applies a force to the centrifuge bowl in a direction that urges the first retainer into the interlocking position with the second retainer.

5. A mounting arrangement for a centrifuge comprising:

a rotatable centrifuge turntable having a surface for receiving an object to be rotated;

means provided on the rotatable turntable for mounting the object to the rotatable turntable; and means provided on the rotatable turntable for securing the object to the rotatable turntable with a securing force that increases in response to rotation of the turntable, the securing means comprising a resilient arm having a first end and second end, the resilient arm being mounted to the rotatable turntable adjacent the first end and being connected to a ballast adjacent the second end.

6. The mounting arrangement of claim 5, wherein the securing means applies a securing force that increases as rotational speed of the rotatable turntable increases.

7. The mounting arrangement of claim 5, wherein the securing means decreases the securing force when the rotatable turntable does not rotate.

8. The mounting arrangement of claim 5, wherein the securing means applies a securing force that urges the object in a direction to cooperate with the mounting means.

9. The mounting arrangement of claim 5, wherein the mounting means is at least one of a slot or retainer pin.

10. The mounting arrangement of claim 5, wherein the securing means further comprises:

an aperture in the turntable; and a projection provided at the second end of the resilient arm and extending through the aperture, the resilient arm biasing the projection such that the projection will contact the object.

* * * * *

UNITED STATES PATENT AND TRADEMARK OFFICE

CERTIFICATE OF CORRECTION

PATENT NO. : 5,591,113
DATED : January 7, 1997
INVENTOR(S) : Lawrence Darnell and James Salter It is certified that error appears in the above-indentified patent and that said Letters Patent is hereby corrected as shown below:

Title page, [75] Inventors: "Morietta, Ga." should read --Marietta, Ga.--.

Title page, [73] Assignee: before "Colo." insert --Lakewood,--.

Signed and Sealed this

Eighteenth Day of March, 1997

Bruce Lehman

*Attest:*

BRUCE LEHMAN

*Attesting Officer*

*Commissioner of Patents and Trademarks*